US007802699B1

(12) United States Patent
Hoy

(10) Patent No.: US 7,802,699 B1
(45) Date of Patent: Sep. 28, 2010

(54) BEVERAGE TOSSING COOLER AND METHOD TO OPERATE

(76) Inventor: Derek Hoy, 1157 Southwinds Dr., Port Orange, FL (US) 32129

( * ) Notice: Subject to any disclaimer, the term of this patent is extended or adjusted under 35 U.S.C. 154(b) by 292 days.

(21) Appl. No.: 11/963,188

(22) Filed: Dec. 21, 2007

(51) Int. Cl.
*F25D 3/00* (2006.01)
*F41B 3/02* (2006.01)
*B65D 43/16* (2006.01)

(52) U.S. Cl. ..... 221/249; 221/277

(58) Field of Classification Search ..... 221/1, 221/150 R, 151, 208–210, 217, 247–251, 221/254, 258, 268–272, 274, 276–278, 289, 221/311; 124/7, 16, 36
See application file for complete search history.

(56) References Cited

U.S. PATENT DOCUMENTS 202,301 A * 4/1878 Taltavull ..... 124/7
3,512,298 A * 5/1970 Poynter ..... 446/9
3,977,386 A * 8/1976 Meyer ..... 124/7
4,262,648 A * 4/1981 Wegener et al. ..... 124/6
4,611,571 A * 9/1986 Tressler et al. ..... 124/7
5,619,977 A * 4/1997 Gatin ..... 124/7

* cited by examiner

*Primary Examiner*—Gene Crawford
*Assistant Examiner*—Kelvin L Randall, Jr.
(74) *Attorney, Agent, or Firm*—Lawrence J. Gibney, Jr.

(57) ABSTRACT

For the entertainment of individuals and for the convenience of others a method to eject a can from a cooler is described. A refrigerated cooler that houses a plurality of cans will have the ability to eject a can through an opening in the top of the cooler using a remote control device. Once the can has been ejected a small electric motor in the interior of the device will automatically reset a catapult arm and will permit another can to be automatically loaded onto the cradle at the end of the catapult beam.

16 Claims, 6 Drawing Sheets

BEVERAGE TOSSING COOLER AND METHOD TO OPERATE

BACKGROUND OF THE INVENTION

A. Field of the Invention

This relates to the storage of a cold beverage in a cooler-shaped device and being able to eject the can from the interior of the cooler. The device will be able to eject a refrigerated can through the top of the cooler assembly to an individual by operating a remote-controlled device such as a pushbutton on a key chain.

B. Prior Art

There are other prior art references to coolers and a multitude of devices related to remote-controlled operated equipment. However, none of the prior art references specifically have a cooler that will eject a beverage from the interior of the cooler.

One relevant prior art reference can be found at a website to advertise a device that will retrieve a can from the interior of a refrigerated compartment and toss or throw the can a predetermined distance once the can has been moved from the interior of the compartment to the exterior of the device. The device is known as a Beer Launcher. The tossing of that can occurs from the exterior of the device; the current device catapults the can from the interior of the device through an opening on the top surface to the individual. While the concept is similar, the way in which it is accomplished is different between the devices.

BRIEF SUMMARY OF THE INVENTION

This device is a refrigerated cooler with a handle, which may telescope, on one side and a pair of wheels on the same side as the handle; the handle on the same side allows a person to tilt the device and roll it.

The cooler will have a cubic structure with defined sidewalls, a defined top, and a defined bottom. On the top surface will be a hinged door that will open and close, depending on whether or not a can of beer or soda is traveling through the hinged door. The cooler will be refrigerated in order to keep the cans which are stored in the device cool. Several different types of means of refrigeration may be used including a thermo-electric cooler.

Inside the cooler will be a catapult system, which is comprised of a catapult arm, a catapult arm spring, a solenoid, a latch mechanism and a pivot point, that ejects the can from the interior of the cooler. A catapult arm, which is part of the catapult system, is held in place by a latch that is secured by a spring on one side of the divider.

The power source for the catapult system will be direct current from a battery or plurality of batteries; the direct current will operate the solenoid system, a set of limit switches, a small electrical motor. The operation of the catapult system will be controlled by remote control device similar to a car opening device and this type of device is common in the prior art. Alternating current may be used but must be converted to direct current to operate the system. The use of direct current also has the advantage of allowing the device to be portable.

Within the interior will be two partitions—a magazine wall and a divider wall. The first partition—magazine wall—will separate the cans from the catapult arm. The second partition—divider—will separate the catapult arm from the electrical and mechanical equipment that is used to operate the catapult system and the catapult arm and will provide a surface on which to mount various pieces of equipment such as the solenoid system, limit switches, a stop mechanism, an electrical motor to name a few of the items that will need to be mounted.

The space between the magazine wall and the divider provides a space in which the catapult arm will move. The respective magazine wall and divider will also insure that the catapult arm will not strike a can or damage any of the needed electrical or mechanical equipment that will be used to operate the catapult system.

The entire interior area of the cooler will be refrigerated and will house a plurality of cans, which are stowed in the interior of the cooler. The cans will rest on an inclined member so that the cans will be able to automatically reload.

In operation, the catapult arm is secured to a pin that passes through the magazine wall and the divider; the catapult arm will rotate around this pin and the pin secures the catapult arm to the interior of the device. On one end of the catapult arm will be a cradle to cup a can. On the opposite end of the arm and attached to the catapult arm will be a catapult arm spring that secures the catapult arm. When the catapult arm is ready to be activated, the cradle of the catapult arm will house a can and have a slightly downward orientation. The catapult arm spring on the other end of the catapult arm will provide tension.

In this position (with a can in the cradle) the catapult arm is maintained in positioned by a latch mechanism and more specifically by the lip on the latch mechanism that is secured to a solenoid; the latch mechanism passes through an opening in the divider wall for that purpose. The solenoid assembly-solenoid, solenoid piston and latch—is secured to one side of the divider and held in place by a spring. The latch mechanism is connected to the solenoid piston. When the current is supplied to the solenoid, the solenoid piston will retract and move downward; this movement forces the solenoid to move which in turn moves the latch mechanism that is holding the catapult arm in position.

Because a catapult arm spring on one end of the catapult arm provides tension, when the latch is moved a certain distance, the catapult arm will move upward and force the catapult arm with the can in the cradle upward so that the can be ejected from the interior of the device.

The remote control device sends a signal to a receiver that in turn sends a signal to activate the solenoid. A series of limit switches are provided and contact the catapult arm and the motor.

As the catapult arm moves upward to eject the can and prior to the can reaching the level of the opening for the door in the top of the cooler a means to open the lid will be deployed and this will force the lid open prior to the can reaching the top. This means to open will insure that the can is ejected safely from the device with minimum resistance.

A stop mechanism is placed on one side of the divider wall to prevent the movement of the catapult arm beyond a certain point to insure that other components of the device are not damaged.

Once the can is ejected, the position of the catapult arm in no longer in a downward inclination but instead the cradle of the catapult arm is positioned in an upward inclination near the lid on the top surface of the cooler. The position of the catapult arm has altered the surface that contacts the limit switch and in turn will engage the operation of a small electrical motor to reset the catapult arm. Appropriate linkage will be provided so that the catapult arm is forced downward back into the original position to eject another can. The catapult arm is held in place by the latch mechanism that is controlled by a solenoid. Once the catapult arm returns to its original position, the next can is loaded onto the cradle of the catapult arm automatically.

A plurality of cans will be stored in the device on an inclined member and the next can is automatically rolled onto the cradle of the catapult arm as the catapult arm moves back into position.

Other means to eject the can from the device may also be contemplated. A possible alternative embodiment would be to use a compressed gas source, a pneumatic cylinder and a solenoid to control the movement of the catapult arm.

DETAILED DESCRIPTION OF THE EMBODIMENTS NUMBERING REFERENCE

Figure 1:
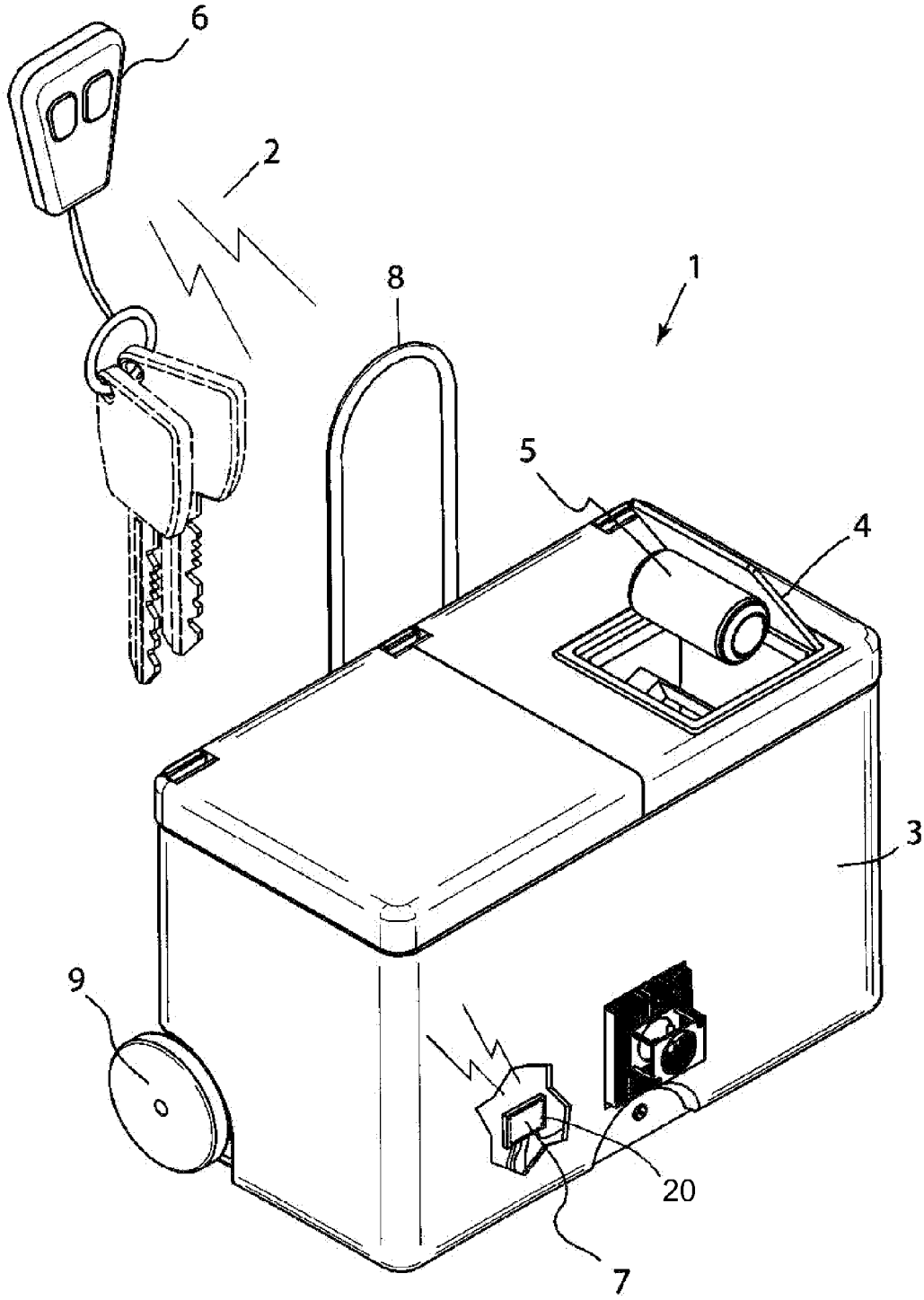
FIG. 1 is an isometric view of the components of the device.

1 Device
2 Signal
3 Cooler
4 Lid
5 Can
6 Transmitter
7 Receiver
8 Handle
9 Wheels
10 Catapult Arm
10A Pivot Point
10B First end of catapult arm
10C Second end of catapult arm
11 Catapult Arm Spring
12 Stop
13 Loading Wheel
14 Cradle
14A Cradle Arms
15 Hole
16 Linkage
17 Motor
18 Magazine Wall
18A First side of Magazine Wall
18B Second side of Magazine Wall
19 Divider
19A First side of Divider Wall
19B Second side of Divider Wall
20 Controller
21 Can Magazine
22 Means to Refrigerate
23 Catapult Arm Limit Switch
24 Electric Motor Limit Switch
25 Solenoid Spring
26 Can Loading Arm
26A Can Loading Arm Tabs
26P Can Loading Arm Pivot Point
27 Solenoid
28 Solenoid Piston
29 Latch
29L Lip of latch
30 Lid opening means
35 Gas Regulator
36 Shut off Valve
40 Solenoid Assembly
45 Gas Canister
48 Pneumatic Cylinder
50 Linkage to catapult arm This device 1 will maintain a refrigerated beverage within a cooler 3 structure and at the same time allow the can 5 to be quickly ejected a through a hinged lid 4 on the top of the cooler 3.

The cooler 3 will have defined sidewalls, a defined bottom, and a defined top surface. On a portion of the top surface will be a lid 4. The lid 4 will open and close as a can 5 is ejected through the opening by a catapult system that is incorporated into the device in the interior; the catapult system will be comprised of a catapult arm 10, catapult arm spring 11, pivot point 10A, ejection mechanism and latch mechanism 29. The lid 4 may be hinged to insure that the lid 4 closes after the can has been ejected.

The cooler will have a set of wheels 9 on one side of the defined sidewalls in order to transport the cooler as well as a handle 8, which may telescope and, therefore, allow the device to be tilted when rolling for the convenience of the user.

The catapult system that is incorporated in the interior of the device will be operated by remote control such as that commonly found with a key chain 6. The remote control will emit a radiofrequency signal 2, which will communicate with a receiver 7 within the interior of the cooler to operate the catapult system; a controller 20 is integrated with the receiver 7 and operates a solenoid assembly. A pair or limit switches 23 and 24 are incorporated in the device to control the operation of a small electrical motor 17, which will be used to reset the catapult arm.

The interior of the device will also be refrigerated or cooled so as to maintain the appropriate temperatures of cans within the cooler. Various ways to refrigerate the interior of the cooler are found and a possible means is a thermo electric cooler 22 which is mounted to the front of the device as depicted in FIG. 1. Other placement positions may be used and the position of the refrigeration unit as depicted in FIG. 1 is merely a representative example. Ice may also be used to cool the contents of the interior of the cooler.

The interior of the cooler will be separated into different sections, first by a magazine wall 18, which separates the catapult arm 10 from the cans. A separate divider wall 19, which has a first side 19A and a second side 19B, separates the mechanical and electrical components on the first side from the catapult arm 10 on the second side. The catapult arm 10, which has a first end 10B and a second end 10C, will be positioned in the space between the magazine wall 18 and the divider 19.

The magazine wall 18 which has a first side 18A and a second side 18B will extend a predetermined length of the cooler in the approximate center along the longitudinal axis of the cooler and will protect the cans from the catapult arm 10. The shape of the magazine wall will allow the catapult arm to freely move as the catapult system is operated. The catapult arm will be secured to the magazine will with a pivot point that is likely to be a pin; regardless of the means to secure the catapult arm, it must allow free rotation of the catapult arm.

In addition to the magazine wall 18 a divider 19 will also be used to mount the various pieces of electrical and mechanical equipment that operate the catapult system. The catapult arm will be located in the cavity that is formed between the magazine wall 18 and the divider 19. The catapult arm may also be secured to the divider as well and alternatively may be secured to both the magazine and the divider.

The catapult arm will be reset by a small electrical motor 17, a loading wheel 13 and appropriate linkage that is mounted to the divider 19. A hole 15 in the divider provides a means for the electrical motor 17 and the linkage 16 to reset the catapult arm.

Figure 4A:
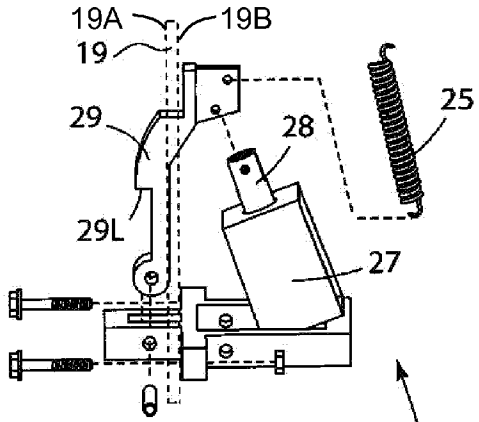
FIG. 4*a* is a view of the portion on FIG. 4 in the circle depicting the solenoid.
Figure 4:
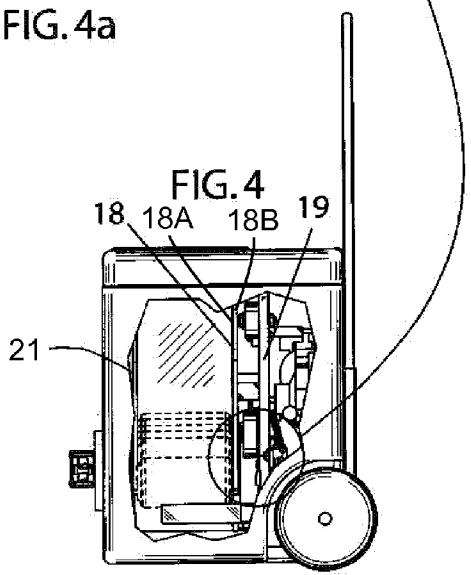
FIG. 4 is a view from the side with the inside of the compartment being depicted.
Figure 2:
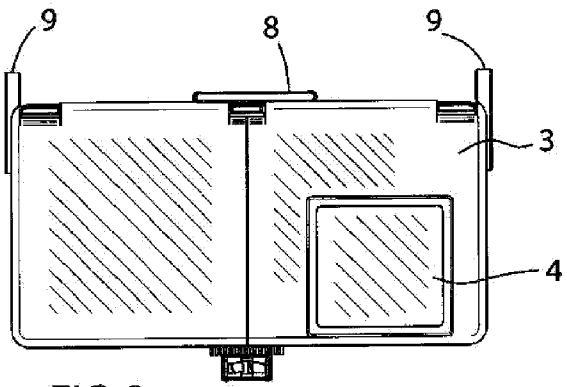
FIG. 2 is a top view of the device.
Figure 3:
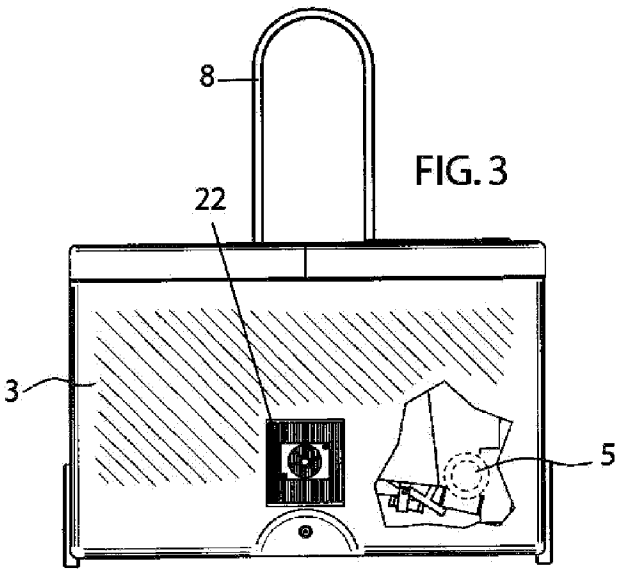
FIG. 3 is a front view of the device with a partial interior view of the interior of the compartment.

After the catapult arm has been reset into the position prior to launching the next can, a latch 29, which is secured by a spring on one side of the divider will maintain the position of the solenoid 27. An opening in the divider as depicted in FIG. 4*a* will provide a means by which the latch mechanism 29 can travel a predetermined distance through the opening in the divider to allow the catapult arm to rotate upward.

A latch mechanism 29 is attached to the ejection mechanism that is depicted as a solenoid piston 28 and maintains the catapult arm in place. One end of the latch mechanism 29 will be secured to the solenoid assembly on one side of the divider wall and the other portion will maintain the catapult arm in place. A portion of the catapult arm will be in contact with the lip of the latch 29L prior to the next can being launched. The lip of the latch 29L will maintain the catapult arm in position prior to launching the next can. An opening in the divider 19 is provided for the latch mechanism 29. When the solenoid 27 is activated, the piston 28 of the solenoid will retract and this will force the latch mechanism to move backward so that the lip 29L no longer secures the catapult arm; with the lip no longer in contact the catapult arm spring 11 forces the catapult arm to rotate around the pivot point 10A, which is likely to be a pin.

With the can in the cradle and the catapult arm locked in position by the latch, there is the danger of accidental discharge which may expose an individual to personal injury. In order to prevent accidental discharge, a locking mechanism will be provided to lock the catapult arm in position. Many different types of locking means may be used including a rod that is operated from the outside of the cooler that slides over a portion of the top surface of the catapult arm near the cradle portion of the catapult arm that will prevent the catapult arm from moving in the event of accidental discharge.

Although a solenoid assembly has been described as the ejection mechanism, other ejection means may also be used. Other alternative means would include a motor driven actuator that will be controlled by the remote controlled device.

Figure 6:
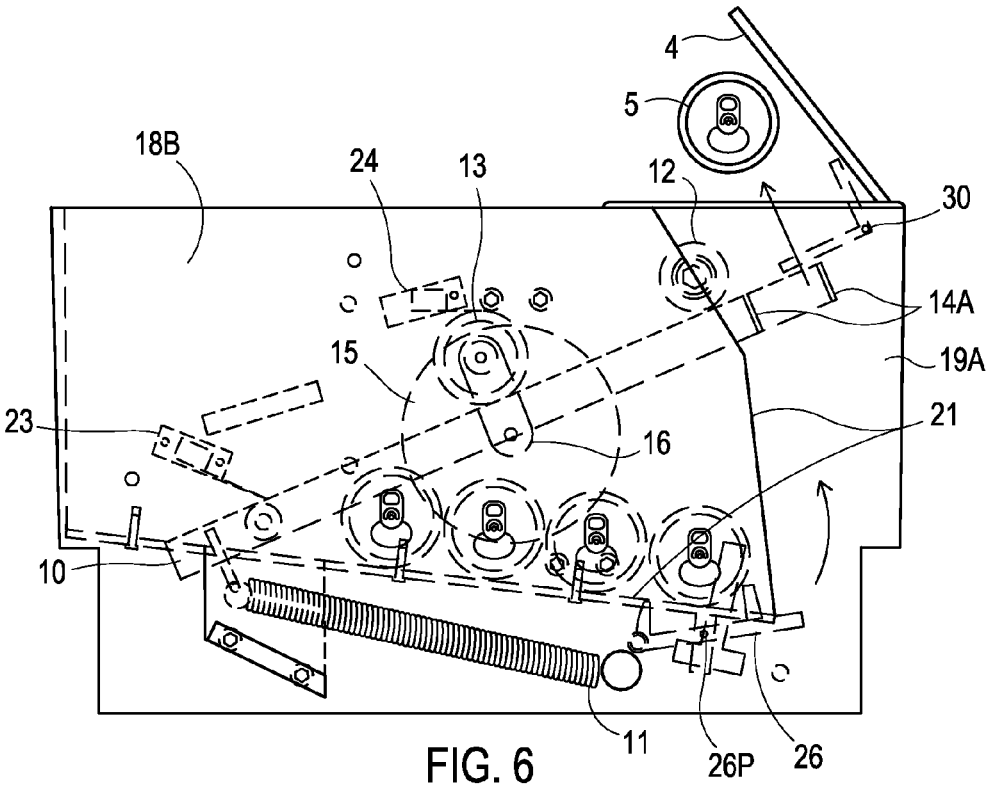
FIG. 6 is a representation of the can being ejected from the device through the hinged door.

With the latch lip 29L no longer contacting the catapult arm and because of the tension that is provided on the opposite end of the catapult arm by the catapult arm spring 11, the catapult arm 10 will rotate around the pivot point 10A to force the catapult arm upward as depicted in FIG. 6 and propel the can 5 through the opening and past the lid 4, that is provided in the opening in the top of the cooler. The tension of the catapult arm spring may be adjusted to control the trajectory of the can.

The catapult arm 10 is secured to the interior of the device by a pivot point 10A that acts as the fulcrum point for the catapult arm.

A means to open the lid 4 prior to the can reaching the door may also be provided to insure that the can is safely ejected from the cooler with minimum resistance. As the catapult arm moves upward, the end of the catapult arm will push the lid opening member 30 upward. As the lid opening member moves upward, it will strike the lid 4 and force it to open before the can is ejected as depicted in FIG. 6.

The limit switches control the resetting of the catapult arm by turning the electric motor off and on at the appropriate times. Specifically when the catapult arm has rotated upwards and ejected the can, the catapult arm limit switch 23 will cause the electric motor to start to reset the catapult arm 10. When the loading wheel 13 has made one complete revolution, the electric motor limit switch 24 will turn the electric motor 17 off until the next can has been ejected and the process starts a new cycle.

Alternatively an electric motor that is equipped with internal sensors may be used to reset the catapult arm. This type of motor would eliminate the need for external limit switches to control the operation of the electric motor when the catapult arm is being reset.

A hole 15 is provided in the divider 19 to allow the linkage 16 and the loading wheel 13 to contact the catapult arm 10. As the loading wheel is rotated clockwise by the electrical motor 17 the catapult arm 10 is forced downward and reset. The loading wheel 13 will contact the catapult arm and the linkage will rotate in a clockwise direction to force the catapult arm downward to be reset as depicted in FIGS. 5 through 8. Once the catapult arm 10 is reset, one end of the catapult arm 10 is held in place by the lip 29L on the latch—29 as depicted in FIG. 4*a*; the latch 29 is held in position by the spring 25 that is secured to the second side of the divider wall 19B. The other end of the catapult arm is secured by the catapult arm spring 11.

In the interior on the side of the divider 19 with the catapult arm 10 will be a flat planar member, which provides a magazine 21 for the cans; this magazine is inclined slightly towards the portion of the catapult arm that provides a cradle for a can so that the next can in the magazine can be loaded onto the catapult arm cradle 14 automatically. The can loading arm 26, will pivot around a point 26P to load the next can. On both sides of the can loading arm will be a series of can loading arm tabs 26A that will allow the next can in the magazine to be loaded but prevent more than one can from being loaded. When the catapult arm 10 is being pushed downward into position a portion of the catapult arm will contact the can loading arm 26 and rotate it slightly around the pivot point 26P to enable the next can to be loaded. The loading arm will be secured by a spring. Other means to load the cans onto the catapult arm cradles may also be used.

A series of cradle arms 14A on one end of the catapult arm will form a cradle for a can. The cradle arms 14A will be spaced so that a can will fit within the cradle arms such that, when the catapult system is deployed, the cradle arms will insure that the can remains on the catapult arm in the cradle portion prior to ejection from the device.

In order to limit the second end of the catapult arm 10C from moving too far, a stop mechanism 12 is provided in the interior on the divider wall; the position of the stop mechanism on the divider may be adjusted (not depicted) to control the can trajectory. As the can exits the device through the lid 4, it will have enough force to be ejected a certain predetermined distance but the stop mechanism will prevent the catapult arm from traveling too far.

The lid 4 is hinged to the top surface of the cooler and may or may not be secured to the top surface with a spring; it is important to minimize any resistance as the can exits through the opening in order to achieve maximum distance with greatest accuracy. A means to open the lid 4 will also be provided so that the lid 4 will open prior to the can reaching the opening. As the catapult arm moves upward, the end of the catapult arm will strike a lid opening device 30 that will travel upward and open the lid 4 prior to the can reaching the opening. The lid opening device will pivot to permit smooth operation. The lid 4 will automatically close after the can 5 has traveled through the opening.

Figure 5:
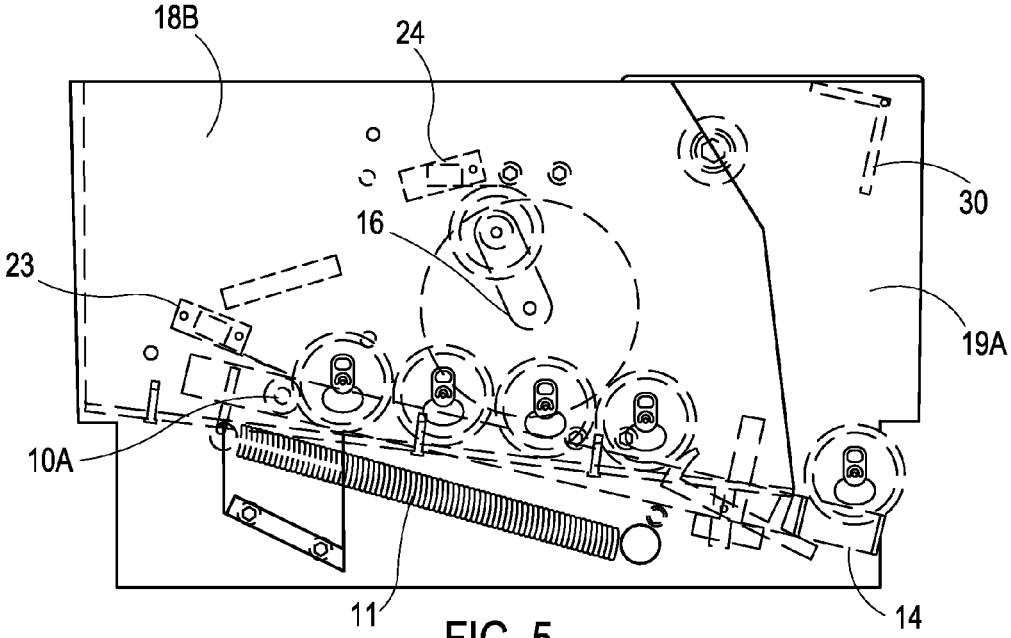
FIG. 5 is a view of the device prior to the can being ejected.

During a typical cycle and prior to ejection of a can 5 such as depicted in FIG. 5 the catapult arm 10 is in a position such that the can in the cradle 14 is positioned at the lowest point in the cooler. The catapult arm 10 is maintained in that position by a latch mechanism—and more specifically by the lip latch 29L—that is held in place by a spring 25. The solenoid 27 is attached to one side of the divider wall 19 and operates a latch 29. The latch will maintain the catapult arm in position when the device is not being used. A spring 25 is attached on one side to the latch 29 and on the other side to the divider wall. Appropriate openings are provided in the divider to allow the free movement of the latch 29 through the divider 19.

The activation of the remote control device 6 will cause the piston 28 of the solenoid to move downward and this movement will in turn move the latch 29 away from the top of the catapult arm and allow the catapult arm to rotate around the pivot point 10A. The catapult arm spring 11 that maintains tension on the first end of the catapult arm 10B forces the catapult arm with the can at the second end of the catapult arm 10C upward towards the lid 4 and the stop mechanism 12. The can is ejected from the device through the lid 4.

When the remote control device 6 is depressed, it sends a signal to a receiver which in turn sends an electrical signal to the solenoid to operate the solenoid. Linkage between the electrical motor, including a loading wheel, and the catapult arm allows the catapult arm to be rotated back into position in order to load the next can. The rotation of the catapult arm 24 back into position will also allow the latch mechanism to again secure the catapult arm in place.

Figure 7:
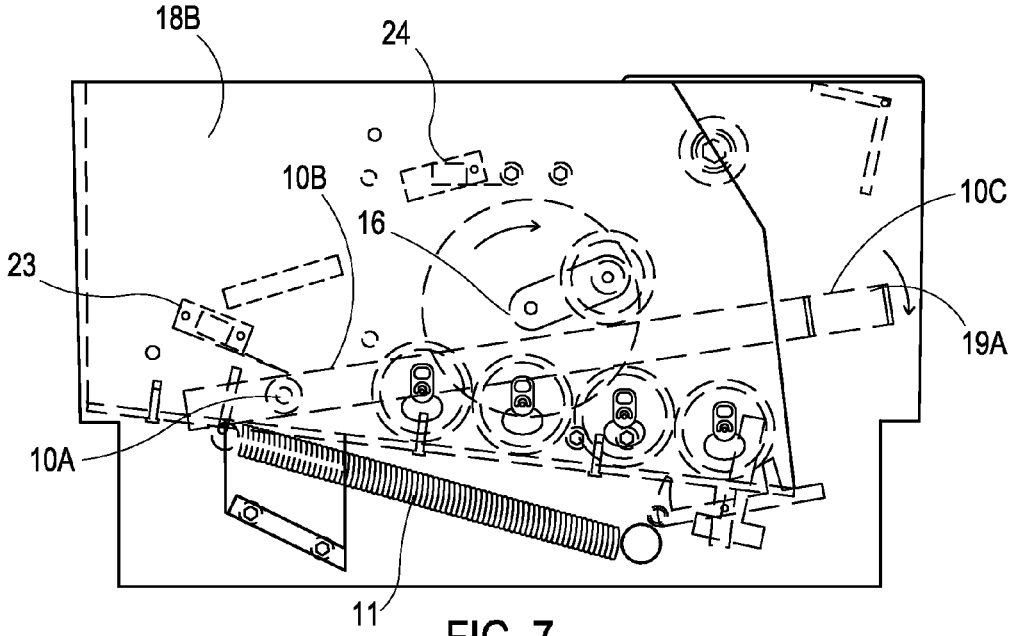
FIG. 7 is view of the device as the catapult arm is being placed back into position.
Figure 8:
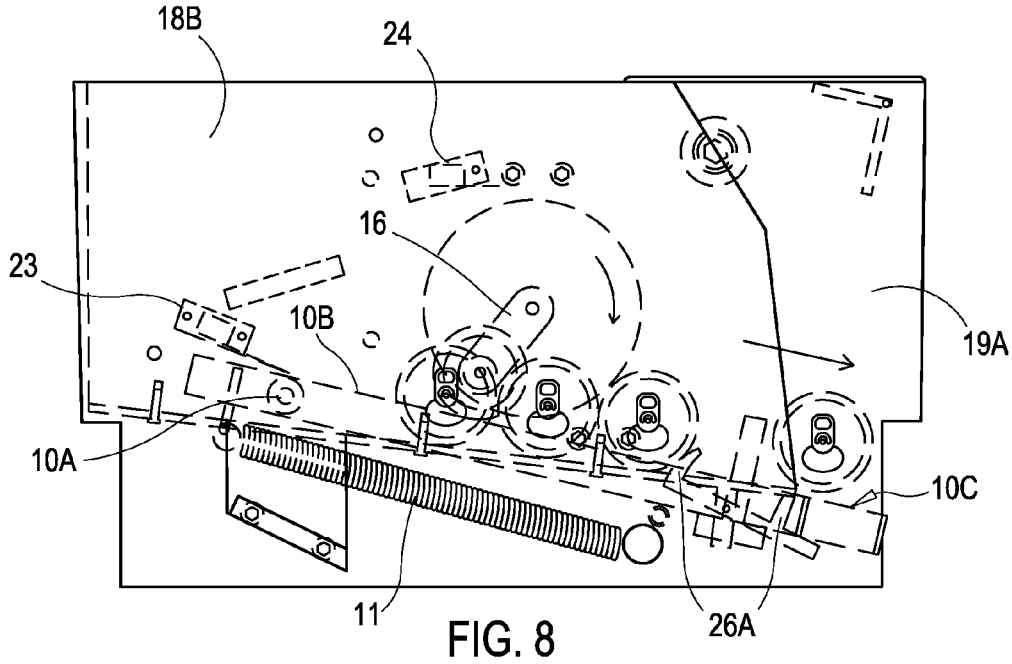
FIG. 8 is a representation of a view of the device as the next can is loaded onto the catapult arm.
Figure 9:
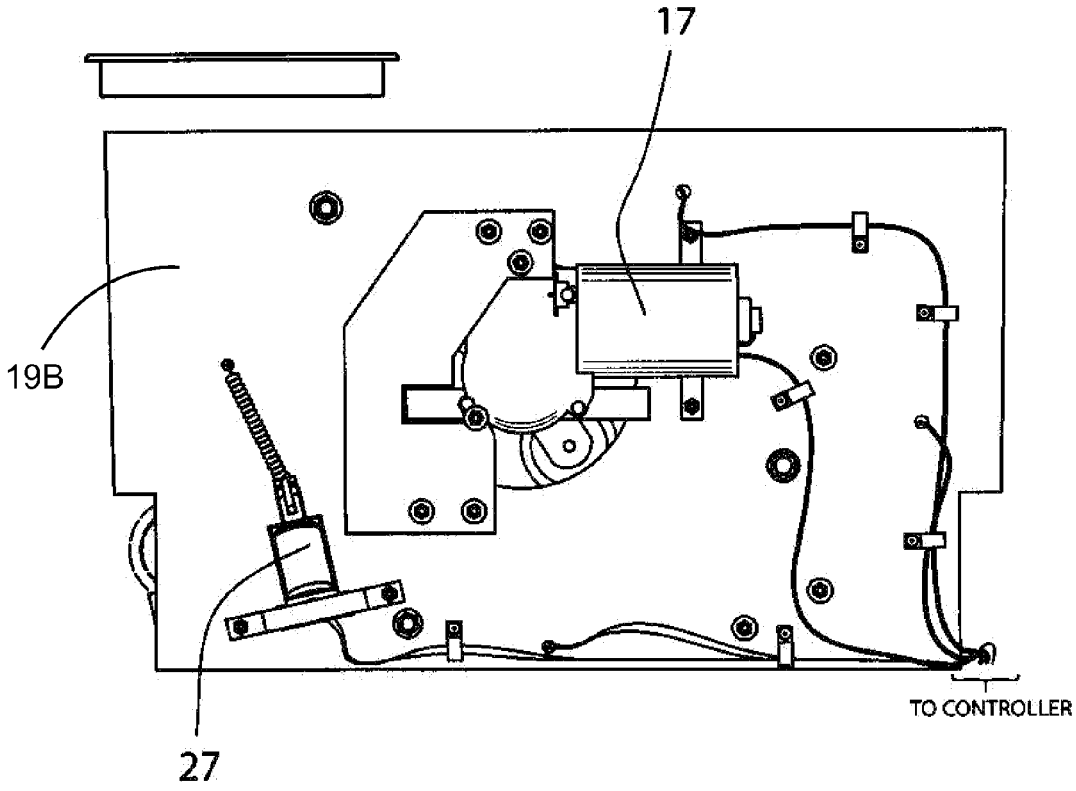
FIG. 9 is a view of the components of the device that operate the catapult arm.

After the can is ejected such as depicted in FIG. 6, the catapult arm 10 is then lowered by rotation of the linkage 16 and a loading wheel 13 that touches the top surface of the catapult arm. A catapult arm spring 11 in the interior provides the force for the catapult arm 10 as it pivots around the fulcrum point. As the catapult arm 10 is lowered such as depicted in FIG. 7, the next can is loaded at the second end of the catapult arm 10C as depicted in FIG. 8 by the rotation of a loading arm 26. The loading arm 26 is secured to the interior of the device and will rotate around a pivot point, probably a pin; the loading arm will have a series of tabs 26A that extend vertically from the surface to gently permit movement of a single can onto the cradle 14 of the catapult arm 10 and at the same time to prevent the movement of more than one can onto the cradle. A spring which is connected to the loading arm 26 controls the movement of the loading arm.

After the next can is placed on the cradle 14 within the arms 14A for that purpose the next can is ready to be ejected through the opening and the process is repeated by depressing the remote control device 6.

Alternative Embodiment

Figure 11:
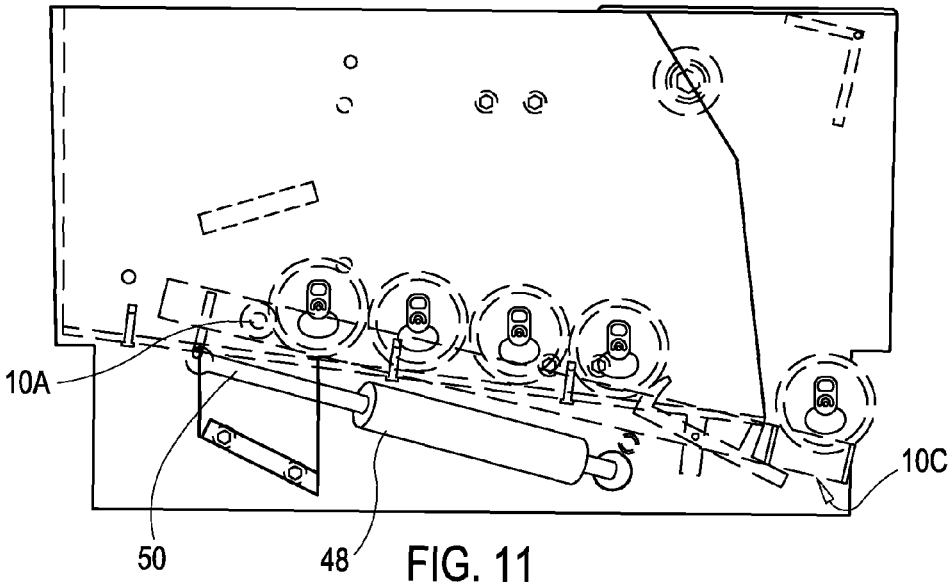
FIG. 11 is a front view of the pneumatic cylinder of the alternative embodiment.

Other means to operate the catapult arm may also be employed. One possible means is to use a compressed gas source 45 that will operate a pneumatic cylinder 48 that is linked 50 to and will control the movement of the catapult arm such as depicted in FIG. 11.

Figure 10:
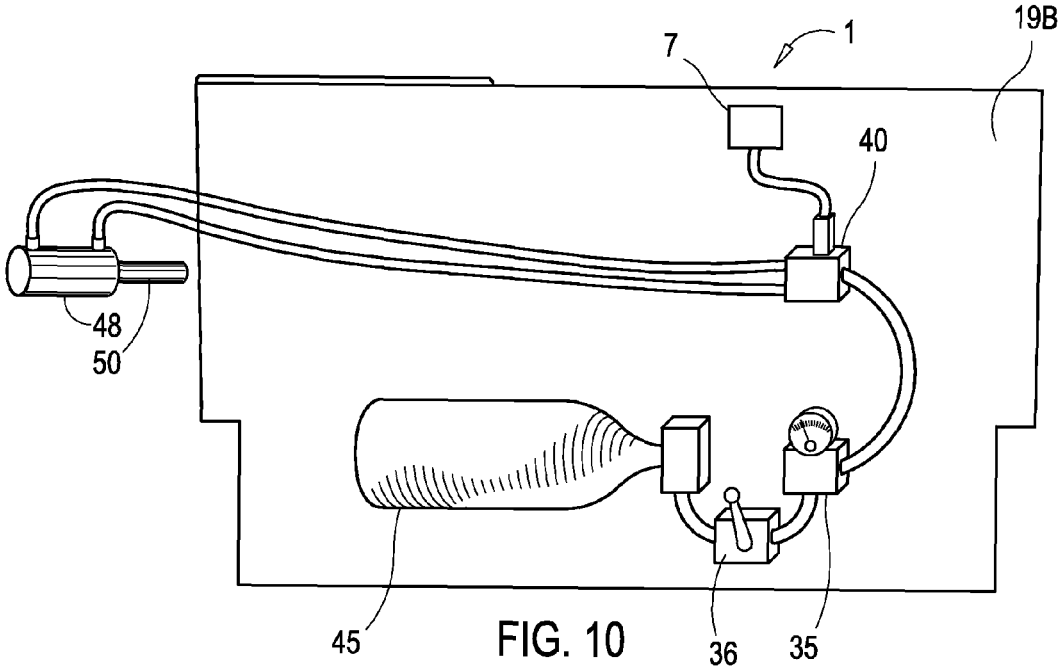
FIG. 10 is a view of the components of the alternative embodiment using a pneumatic cylinder.

A solenoid assembly 40 that is activated by the remote control device that sends a signal to the receiver 7 will be used to control the movement of the pneumatic cylinder 48 which in turn controls the movement of the catapult arm. A regulator valve assembly 35 will also be included to control the pressure in the system; a shut off valve 36 will also be included in order to service the system. The components of this alternative embodiment are depicted in FIGS. 10 and 11.

Although different types of gases may be used in this alternative embodiment, it is anticipated that compressed carbon dioxide will be used because it is relatively inexpensive, safe and easy to use.

Second Alternative Embodiment

Another means to operate the catapult arm may also include the use of an electrical motor that acts directly on a pivot shaft or with gears to directly operate the catapult arm. With the appropriate signal from the remote control device, the motor will rotate the catapult arm at the pivot point which in turn will force the catapult arm to rotate and cause a can to be ejected.

While the embodiments of the invention have been disclosed, certain modifications may be made by those skilled in the art to modify the invention without departing from the spirit of the invention.

The inventor claims:

1. A beverage tossing cooler, which is comprised of:

a. a cooler;

wherein the cooler is a refrigerated;

wherein the cooler has defined sidewalls, a defined top, and a defined bottom;

b. an opening on a surface;

wherein a hinged lid is provided on the surface;

c. a magazine wall;

wherein the magazine wall is provided in the interior along the longitudinal axis of the cooler;

wherein the magazine wall has a first side and a second side;

wherein the magazine wall provides a partition within the cooler;

d. divider;

wherein the divider has a first side and a second side;

wherein the first side of the divider is adjacent to the catapult arm;

said divider provides mounting space for mechanical and electrical components of the device;

wherein an electrical motor is mounted to the second side of the divider;

wherein an ejection mechanism is placed on the second side of the divider;

wherein the catapult arm is positioned in the cavity between the divider and the magazine wall;

wherein an opening is provided in the divider;

e. a can magazine;

wherein a can magazine is provided;

said can magazine provides a storage area for the cans;

said can magazine is slightly inclined towards the cradle portion of a catapult arm;

f. a catapult arm;

wherein the catapult arm has a first end and a second end;

wherein the first end holds a can;

wherein a set of arms is provided on the first end of the catapult arm;

wherein the first end of the catapult arm is located in the interior of the cooler;

said first end of the catapult arm has a series of tabs that form a cradle for a can;

wherein the catapult arm is secured to the magazine wall and the divider;

wherein a means to secure the catapult arm is provided;

g. means to rotate the catapult arm;

h. loading arm;

wherein a loading arm is provided to individually load the can onto the catapult arm;

i. a hole;

wherein a hole is provided in the magazine wall;

said hole provides a means to connect an electric motor to appropriate linkage to the catapult beam;

j. an electric motor;

wherein an electric motor is provided;

k. controller;

wherein a controller is provided;

said controller is operated by a transmitter;

wherein the controller controls the operation of the ejection means;

l. receiver;

wherein a receiver is provided;

m. catapult arm limit switch;

wherein a catapult arm limit switch is provided;

said catapult arm limit switch controls the resetting of the catapult arm by starting the electric motor;

said limit switch is mounted to the divider;

n. electric motor limit switch;

wherein an electric motor limit switch is provided;

said electric motor limit switch controls the operation of the electric motor;

said electric motor limit switch is mounted to the divider;

o. ejection mechanism;

wherein an ejection mechanism is secured to the first side of the divider wall;

wherein an ejection mechanism piston is provided;

p. latch mechanism;

wherein a latch mechanism is attached to the ejection mechanism piston;

q. means to open the lid;

wherein mechanical linkage is provided to open the lid prior to the can being ejected from the device;

r. stop mechanism;

wherein the stop mechanism is mounted to the divider;

said stop mechanism prevents the catapult arm from moving beyond a predetermined point;

s. means to refrigerate or cool;

t. power source;

wherein a power source is provided.

2. The device as described in claim 1 wherein the means to refrigerate the interior of the cooler is a thermo-electric cooler.

3. The device as described in claim 1 wherein the means to cool is a predetermined amount of ice.

4. The device as described in claim 1 wherein the means to cool is a refrigerator system.

5. The device as described in claim 1 wherein the power source is direct current.

6. The device as described in claim 1 wherein the power source is alternating current.

7. The device as described in claim 6 wherein a means to convert the alternating current to direct current is provided.

8. The device as described in claim 1 wherein mechanical linkage is provided to open the door when the catapult arm is rotated upward to eject a can.

9. The device as described in claim 1 wherein the ejection mechanism is a solenoid assembly.

10. The device as described in claim 1 wherein the ejection mechanism is a motor driven actuator.

11. The device as described in claim 1 wherein the means to rotate the catapult arm is a catapult arm spring.

12. The device as described in claim 1 wherein the tension of the catapult arm spring can be adjusted to alter the can trajectory.

13. The device as described in claim 1 wherein the stop mechanism can be adjusted to alter the can trajectory.

14. The device as described in claim 1 wherein the means to rotate the catapult arm is further comprised of a compressed gas source, solenoid valve, regulator and pneumatic cylinder.

15. The device as described in claim 1 wherein the means to rotate the catapult arm is further comprised of an electric motor, to directly rotate the catapult arm.

16. The device as described in claim 1 internal sensors to control the operation of the electric motor.

* * * * *